United States Patent [19]

Reed et al.

[11] 4,090,894

[45] May 23, 1978

[54] MOLDABLE ETHYLENE/VINYL ACETATE COPOLYMER

[75] Inventors: Russell Reed, Ridgecrest; Horace D. Stanton, China Lake, both of Calif.

[73] Assignee: The United States of America as represented by the Secretary of the Navy, Washington, D.C.

[21] Appl. No.: 779,653

[22] Filed: Mar. 21, 1977

[51] Int. Cl.[2] ..... C06B 45/10

[52] U.S. Cl. ..... 149/19.91; 149/11; 149/92; 264/3 R

[58] Field of Search ..... 149/19.91, 92, 19.9, 149/11; 264/3 R

[56] References Cited

U.S. PATENT DOCUMENTS

| | | | |
|---|---|---|---|
| 3,296,041 | 1/1967 | Wright | 149/2 |
| 3,428,502 | 2/1969 | Evans | 149/92 X |
| 3,544,360 | 12/1970 | Gardner | 149/92 X |
| 3,993,838 | 11/1976 | Heytmeijer et al. | 149/19.91 X |

*Primary Examiner*—Edward A. Miller

*Attorney, Agent, or Firm*—R. S. Sciascia; Roy Miller; Lloyd E. K. Pohl

[57] ABSTRACT

Ethylene vinyl acetate copolymer resins are used as desensitizers and binders of moldable explosive compositions of cyclic nitramines, such as RDX. 82 - 98 weight percent binder is used and various ratios of ethylene to vinyl acetate moieties in the resin are used to modify molding and extrusion properties.

6 Claims, No Drawings

MOLDABLE ETHYLENE/VINYL ACETATE COPOLYMER

BACKGROUND OF THE INVENTION

The present invention relates to moldable explosives.

During World War II the British introduced the use of an explosive composition, containing 91± .07 percent RDX (cyclotrimethylenetrinitramine) and 9± .07 percent beeswax, which was highly suitable for press loading. The beeswax has been replaced with a petroleum wax designated Grade A and the explosive composition is known to the military as A-3. Grade A is a micro-crystalline parafinic wax.

The wax is used to coat the particles and act as a binding agent when the composition is pressed. When coated on the particles, the wax desensitizes them to premature explosion from friction, shock and other stimuli.

A-3 is manufactured by heating a water slurry of RDX to nearly 100° C with agitation. The wax is added and the slurry is allowed to cool with continued agitation until the wax solidifies. The solids are filtered and dried.

A-3 and related explosives are moldable and therefore suitable for press loading due to the flow properties imparted to the composition by the wax. In press loading, a container, commonly a bullet-shaped projectile, is loaded from the nose by adding layers of explosive then pressing each layer with a ramrod-like device. When pressed, the material must flow outward and upward to some degree to coat the wall of the container.

Pressloading may be carried out either at room temperature (cold pressing) or at elevated temperatures (hot pressing). A-3 is loaded by cold pressing, a safer and simpler technique.

Grade A wax being a petroleum derivative, has become considerably more expensive and difficult to obtain; a search for a substitute binder with desensitizing and flow properties equivalent to Grade A wax provided the impetus for the present invention.

DESCRIPTION OF THE PREFERRED EMBODIMENT

The polymers of the present invention are random or block copolymers. The two monomer units do not regularly alternate. Rather, they are present in sections of various lengths (termed herein "moieties") of ethylene monomers and vinyl acetate monomers. Such copolymers are termed polyethylene vinyl acetate or "EVA".

Both polyethylene and polyvinyl acetate are crystalline, hard materials. EVA's are pliable, adhesive materials, because polyethylene chains are rather zig-zag while vinyl acetate chains are not, so linear polymers containing both kinds of chains do not easily form the inter-chain bonds characteristic of rigid polymers.

EVA has been found to be exceptionally well suited for use in pressed explosives. The ethylene moiety provides a long hydrocarbon chain for lubricity, but not so long as to be crystalline. The vinyl acetate moiety provides polar groups which are attracted to the surface of RDX making the polymer an excellent wetting agent. Ester groups in the polymer function as Lewis bases and have an affinity for nitro groups (Lewis acids) in the explosive. Whereas most binders do not adhere to RDX at all, EVA adheres to it with remarkable strength, separating from it in strands.

Its affinity for nitro groups makes EVA adaptable for use with most, if not all, nitro explosives, and especially the cyclic nitramine class of explosives, including, in addition to RDX, HMX(1,3,5,7-tetranitrazacyclooctane).

EVA's are available commercially with various ratios of ethylene to vinyl acetate groups. For instance, EVA 638, marketed as ULTRATHENE by U.S. Industrial Chemical Co., has a 70:30 ratio. Vynathene 907, also from U.S. Industrial Chemical Co., has a 40:60 ratio. Vynathene has a lower glass transition temperature than the 638, making it softer and suitable for coldpressing.

The properties of some compositions made from the 638 are summarized in the following table:

| | Comp A-3 | | Comp A-4 | | |
|---|---|---|---|---|---|
| | 9% Grade A Wax | EVA/9% RDX | 3% Grade A Wax | EVA/3% RDX | EVA/5% RDX |
| Composition analysis % binder | 9 | 8.9 | 3 | 2 | 4.1 |
| Impact sensitivity, 50% Pt cm | 30 | 30 | 17 | 19 | 27 |
| Friction sensitivity, lb | 646 | 589 | 324 | 389 | 490 |
| Electrostatic sensitivity at 0.255 joules | 10/10 NF | 10/10 NF | 10/10 NF | 10/10 NF | 10/10 NF |
| Pressed density, gm/cc | 1,649 | 1,632 | 1,704 | 1,715 | 1,694 |
| Compressive strength, psi | 752 | 1,022 | 746 | 1,634 | 1,358 |
| Modulus of elasticity, $\times 10^6$ | 0.18 | 0.03 | 0.06 | 0.11 | 0.08 |
| Abrasion test, % loss | 5 | 0.60 | 11 | 1.8 | 0.66 |
| Small scale cook-off | mild | mild | — | — | — |

SUMMARY OF THE INVENTION

Polymers containing both vinyl acetate and ethylene moieties provide desensitizing and molding properties equivalent to or superior to those of Grade A wax. The adhesive properties of these polymers make them suitable for use with a variety of explosives. By modifying the ratio of vinyl acetate to ethylene or polyethylene moieties, various flow characteristics can be obtained making the compositions suitable for either hot pressing or cold pressing.

In all cases the EVA compositions are comparable to the corresponding wax compositions. Compositions from 2 to 9 percent RDX corresponding to presently used military explosives have been prepared and found suitable. Eighteen percent EVA is the maximum amount of binder desired for the present invention, since in general, binder content is to be minimized.

The EVA 638/9% RDX composition has been successfully press loaded into 5 inch projectiles, but hot pressing was required. By substituting Vynathene 907 cold pressing was accomplished. Also, better friction sensitivity, on the order of 800 lbs., was recorded. Other operations are possible with EVA 638 (or other 40:60 EVA), such as extrusion, making possible the manufacture of explosive rods or pellets of the present composition.

Other advantages of EVA reside in its thermal properties. EVA/RDX compositions can be temperature cycled without cracking. Also, EVA, unlike other polymeric binders, endothermically breaks down at high temperatures, and acts as a heat sink for the explosive.

The compositions of the above table were prepared as follows: 10% EVA was dissolved in benzene or tetrahydrofuran and added with stirring to an RDX/water slurry, which is stirred until mixing is complete, then filtered and dried.

What is claimed is:

1. An explosive composition consisting essentially of from 2 to 18 weight percent of a pliable, adhesive, desensitizing ethylene/vinyl acetate copolymer having a ratio of ethylene groups to vinyl acetate groups in the range of from 70:30 to 40:60; and from 82 to 98 weight percent cyclic nitramine explosive; said composition having the property of being moldable.

2. The composition of claim 1 wherein said cyclic nitramine explosive is cyclotrimethylenetrinitramine.

3. The composition of claim 2 consisting essentially of 9 weight percent ethylene/vinyl acetate copolymer having approximately 30% vinyl acetate moisties and 70% ethylene moieties.

4. The composition of claim 1 wherein said ethylene/vinyl acetate copolymer has approximately 60% vinyl acetate moieties and 40% ethylene moieties.

5. The composition of claim 4 having approximately 9 weight percent ethylene/vinyl acetate copolymer and 91 weight percent cyclotrimethylenetrinitramine.

6. In a method of loading an explosive composition, the improvement residing in using, as the explosive composition, a composition consisting essentially of from 2 to 18 weight percent of a pliable, adhesive, desensitizing ethylene/vinyl acetate copolymer and from 82 to 98 weight percent cyclic nitramine explosive and pressing the composition into a desired shape.

* * * * *